US009631876B2

(12) United States Patent
Zima et al.

(10) Patent No.: US 9,631,876 B2
(45) Date of Patent: Apr. 25, 2017

(54) HEAT EXCHANGER

(71) Applicant: MAHLE International GmbH, Stuttgart (DE)

(72) Inventors: Mark James Zima, Clarence Center, NY (US); Prasad Shripad Kadle, Williamsville, NY (US); Veeraj Chopra, Lockport, NY (US); Debangshu Majumdar, Lockport, NY (US)

(73) Assignee: MAHLE International GmbH, Stuttgart (DE)

( * ) Notice: Subject to any disclaimer, the term of this patent is extended or adjusted under 35 U.S.C. 154(b) by 573 days.

(21) Appl. No.: 13/846,959

(22) Filed: Mar. 19, 2013

(65) Prior Publication Data

US 2014/0284033 A1 Sep. 25, 2014

(51) Int. Cl.

| | |
|---|---|
| ***F28F 3/08*** | (2006.01) |
| ***F28D 9/00*** | (2006.01) |
| ***F28D 21/00*** | (2006.01) |
| ***F02M 26/32*** | (2016.01) |

(52) U.S. Cl.

CPC ..... *F28F 3/08* (2013.01); *F02M 26/32* (2016.02); *F28D 9/0043* (2013.01); *F28D 21/0003* (2013.01)

(58) Field of Classification Search

CPC ..... F28D 1/0333; F28D 9/0043; F28F 3/025
USPC ..... 165/152, 153, 167
See application file for complete search history.

(56) References Cited

U.S. PATENT DOCUMENTS

| | | | | |
|---|---|---|---|---|
| 3,460,611 | A * | 8/1969 | Folsom et al. | 165/166 |
| 4,073,340 | A * | 2/1978 | Parker | 165/166 |
| 4,291,754 | A * | 9/1981 | Morse et al. | 165/165 |
| 5,101,891 | A * | 4/1992 | Kadle | 165/152 |
| 5,176,205 | A | 1/1993 | Anthony | |
| 6,293,337 | B1 | 9/2001 | Strahle et al. | |
| 6,341,649 | B1 * | 1/2002 | Joshi et al. | 165/153 |
| 7,013,962 | B2 * | 3/2006 | Sanatgar et al. | 165/152 |
| 7,121,331 | B2 * | 10/2006 | Yoshida et al. | 165/166 |
| 8,028,410 | B2 * | 10/2011 | Thompson | 29/890.039 |
| 2001/0025705 | A1 * | 10/2001 | Nash et al. | 165/167 |
| 2003/0010479 | A1 | 1/2003 | Hayashi et al. | |
| 2003/0024696 | A1 | 2/2003 | Haplau-Colan et al. | |
| 2005/0230092 | A1 * | 10/2005 | Emrich et al. | 165/167 |
| 2005/0284620 | A1 * | 12/2005 | Thunwall et al. | 165/167 |
| 2006/0231241 | A1 | 10/2006 | Papapanu et al. | |
| 2007/0044946 | A1 | 3/2007 | Mehendale et al. | |

(Continued)

*Primary Examiner* — Allen Flanigan
(74) *Attorney, Agent, or Firm* — Brinks Gilson & Lione

(57) ABSTRACT

A heat exchanger includes a stack of heat exchanger plate pairs that each define an internal volume and include an inlet and an outlet such that a first medium flows from the inlet to the outlet along a flow axis. The inlets together form an inlet header through the heat exchanger plate pairs and the outlets together form an outlet header through the heat exchanger plate pairs. The heat exchanger also includes an array of fins disposed between and in thermal contact with adjacent heat exchanger plate pairs. The array of fins defines flow channels between the adjacent heat exchanger plate pairs such that a second medium flows through the flow channels along the flow axis. One end of the array of fins includes a cut-out area which causes a first portion of the array of fins to be positioned laterally from either the inlet header or the outlet header.

12 Claims, 5 Drawing Sheets

(56) References Cited

U.S. PATENT DOCUMENTS

| | | | | |
|---|---|---|---|---|
| 2007/0181294 | A1 | 8/2007 | Soldner et al. | |
| 2008/0223024 | A1 | 9/2008 | Kammler et al. | |
| 2009/0126911 | A1* | 5/2009 | Shore et al. ..... | F28D 1/0325 165/109.1 |
| 2010/0001086 | A1 | 1/2010 | Bhatti et al. | |
| 2011/0289905 | A1 | 12/2011 | Acre et al. | |

* cited by examiner

HEAT EXCHANGER

TECHNICAL FIELD OF INVENTION

The present invention relates to a heat exchanger; more particularly to a heat exchanger having a stack of heat exchanger plate pairs for flowing a first medium, the heat exchanger plate pairs being separated by arrays of fins defining flow channels for flowing a second medium; even more particularly to such a heat exchanger having inlet headers through the stack of heat exchanger plate pairs for introducing the first medium to each heat exchanger plate pair and an outlet header through the stack of heat exchanger plate pairs for discharging the first medium from each heat exchanger plate pair; and yet even more particularly to such a heat exchanger where the arrays of fins include fin cut-out areas which allow the arrays of fins to be positioned laterally from the inlet header and the outlet header to support adjacent heat exchanger plates while allowing the second medium to flow around the inlet header and outlet header to enter and exit each flow channel.

BACKGROUND OF INVENTION

Heat exchangers are known for transferring heat from a first medium to a second medium. In one example, the heat exchanger may be positioned within an exhaust conduit of an internal combustion. Heat from the exhaust gases produced by the internal combustion engine may be transferred to another medium which may be used, for example only, to elevate the temperature of the air going to the passenger compartment of the motor vehicle for passenger comfort, to warm batteries of hybrid electric motor vehicles which use batteries to store electrical energy to provide or assist in propulsion of the hybrid electric motor vehicle under certain conditions, to warm powertrain fluids of the motor vehicle in order to reduce viscosity of the powertrain fluids, thereby reducing friction and improving fuel economy, or to cool exhaust gases that may be recirculated back into the internal combustion engine.

United States Patent Application Publication No. US 2008/0223024 A1 to Kammler et al. shows an example of such a heat exchanger for cooling exhaust gases produced by an internal combustion engine. The heat exchanger of Kammler et al. includes a plurality of tubes which allow passage of the exhaust gas therethrough. Each of the plurality of tubes passes through a coolant jacket and a liquid coolant is circulated through the jacket. In order to form the coolant jacket, each tube is sealed by welding to a portion of the water jacket. Such a heat exchanger may be difficult and costly to manufacture due to the need to align and seal each tube with a corresponding hole in the water jacket. Furthermore, heat transfer from the exhaust gases to the coolant may be less than satisfactory.

U.S. Pat. No. 6,293,337 to Strähle et al. shows another example of such a heat exchanger for transferring heat from exhaust gases produced by an internal combustion engine to a water coolant. The heat exchanger of Strähle et al. includes a stack of heat exchanger plates through which the water coolant is circulated. The heat exchanger plates are separated by flow channels through which the exhaust gases are passed. The flow channels may include features therein to improve heat exchange with the water coolant in the heat exchanger plates. The heat exchanger plates are connected to each other by collection spaces. The flow channels pass through the collection spaces, and therefore must be sealed from the collection spaces in order to prevent the water coolant from escaping. Such a heat exchanger may be difficult and costly to manufacture due to the need to align and seal each flow channel with corresponding holes in the collection spaces.

What is needed is a heat exchanger which minimizes or eliminates one or more of the shortcomings as set forth above.

SUMMARY OF THE INVENTION

Briefly described, a heat exchanger is provided for transferring heat between a first medium and a second medium. The heat exchanger includes a stack of heat exchanger plate pairs that each define an internal volume and include an inlet for introducing the first medium into the internal volume and an outlet for discharging the first medium from the internal volume such that the first medium flows from the inlet to the outlet along a flow axis. The inlets together form an inlet header through the heat exchanger plate pairs and the outlets together form an outlet header through the heat exchanger plate pairs. The heat exchanger also includes an array of fins disposed between and in thermal contact with adjacent heat exchanger plate pairs. The array of fins defines flow channels between the adjacent heat exchanger plate pairs such that the second medium flows through the flow channels along the flow axis. One end of the array of fins includes a cut-out area which causes a first portion of the array of fins to be positioned laterally from either the inlet header or the outlet header.

BRIEF DESCRIPTION OF DRAWINGS

This invention will be further described with reference to the accompanying drawings in which.

DETAILED DESCRIPTION OF INVENTION

Figure 1:
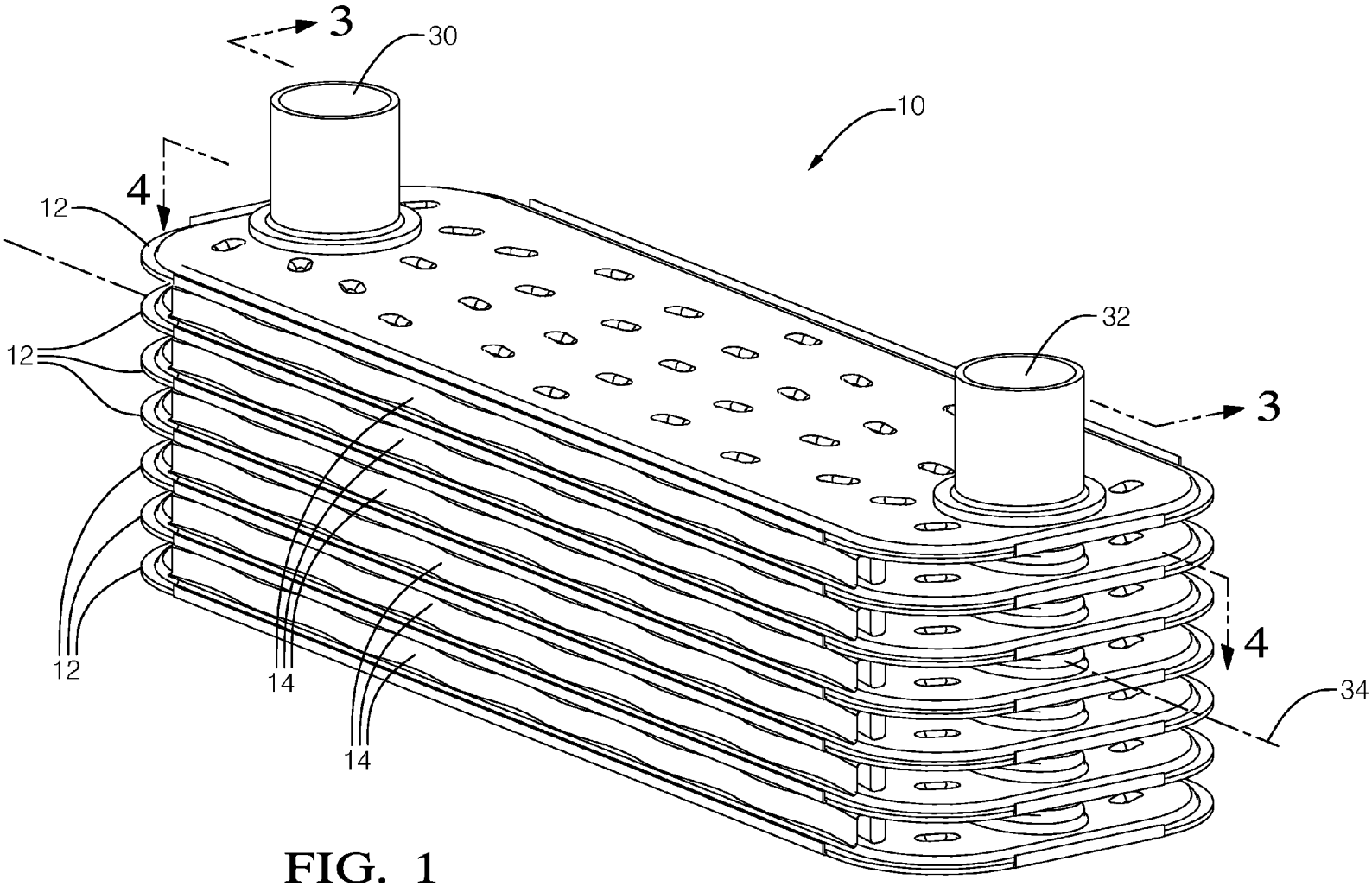
FIG. 1 is an isometric view of a heat exchanger in accordance with the present invention.

Referring to FIG. 1, an isometric view of a heat exchanger 10 is shown for exchanging heat between a first medium and a second medium. Heat exchanger 10 includes a stack of heat exchanger plate pairs 12 which are separated from each other by arrays of fins 14. The first medium flows through heat exchanger plate pairs 12 as will be described later while the second medium flows through the arrays of fins 14 as will also be described later. Heat exchanger 10 may be disposed, for example only, in an exhaust conduit (not shown) of an internal combustion engine (not shown) of a motor vehicle (not shown) for transferring heat from exhaust gases produced by the internal combustion engine to a liquid coolant. The liquid coolant that has been elevated in temperature by the exhaust gases may then be used, for example only, to elevate the temperature of the passenger compartment of the motor vehicle for passenger comfort, to warm batteries of hybrid electric motor vehicles which use batteries to store electrical energy to provide or assist in propulsion of the hybrid electric motor vehicle under certain conditions, or to warm powertrain fluids of the motor vehicle in order to reduce viscosity of the powertrain fluids, thereby reducing friction and improving fuel economy.

Figure 2:
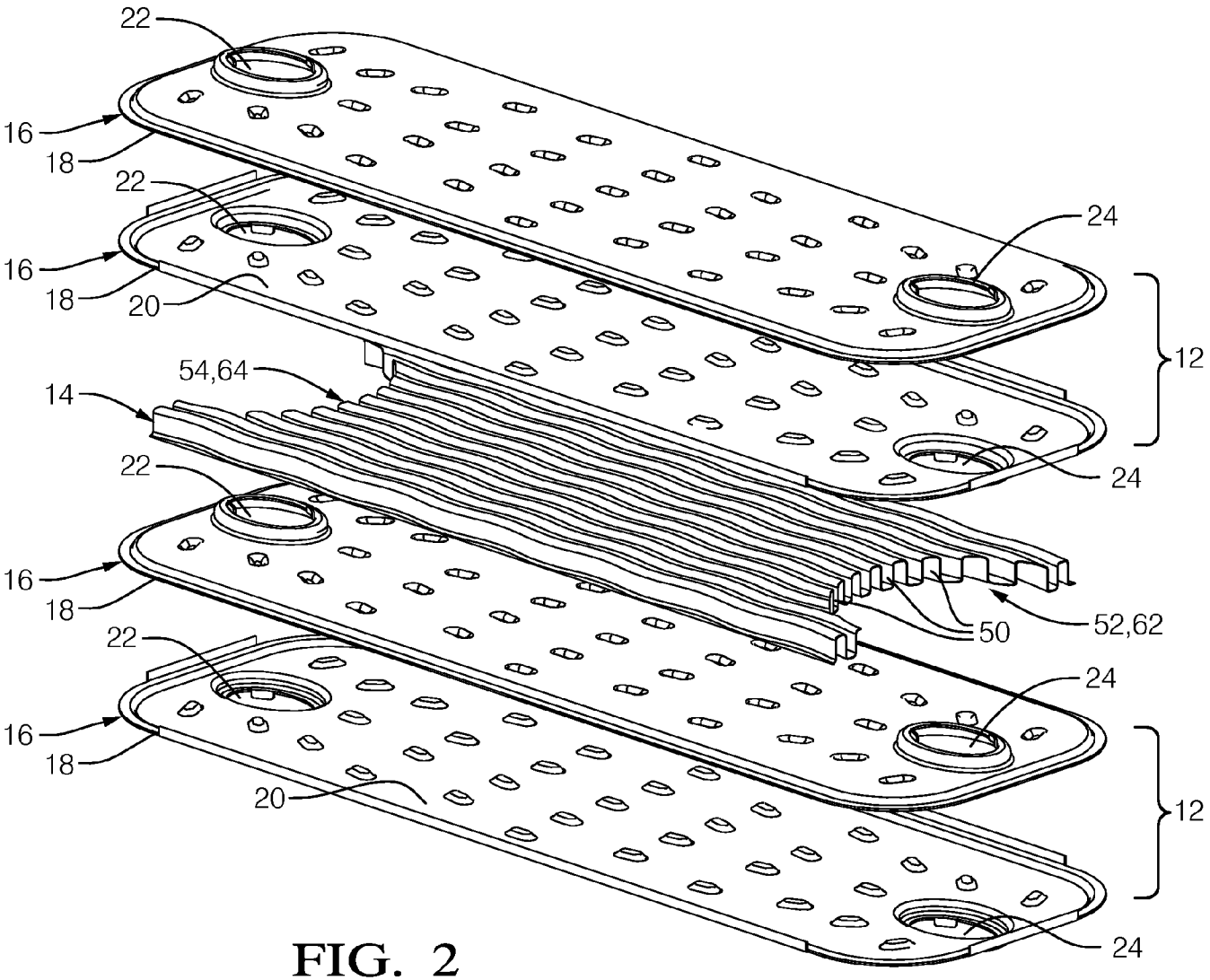
FIG. 2 is an exploded isometric view of a portion of the heat exchanger of FIG. 1.
Figure 3:
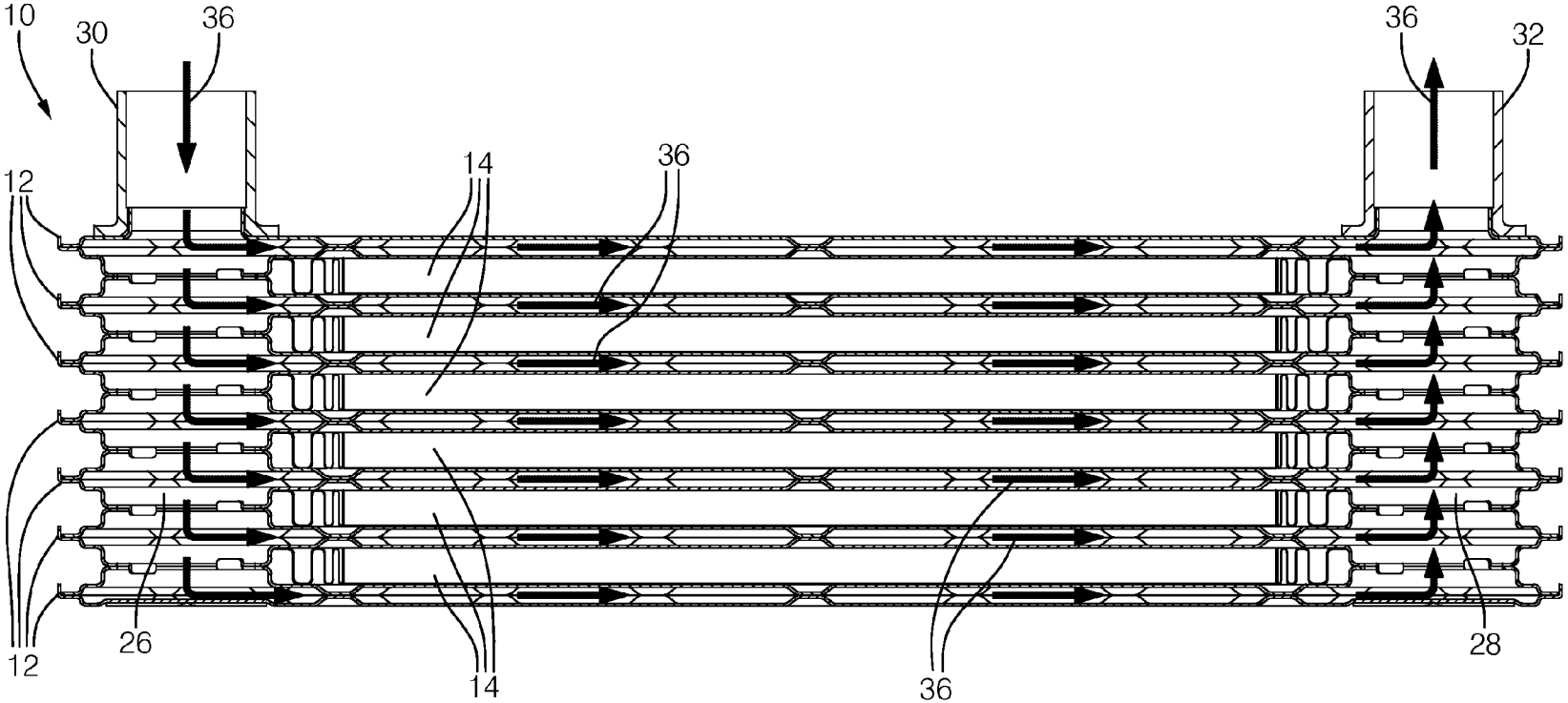
FIG. 3 is a cross-sectional view of the heat exchanger of FIG. 1 taken through section line 3-3.
Figure 4:
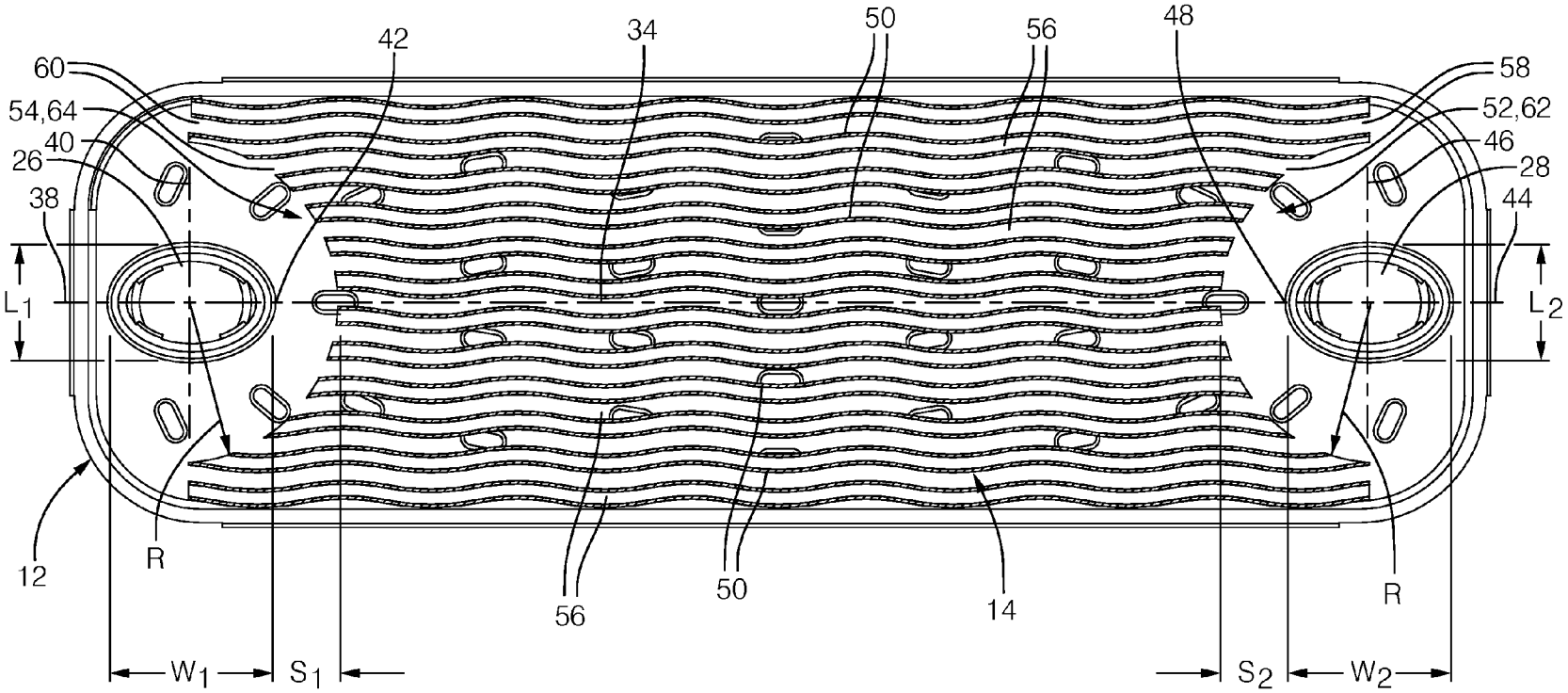
FIG. 4 is a cross-sectional view of the heat exchanger of FIG. 1 taken through section line 4-4.

Heat exchanger plate pairs 12 will be further described with continued reference to FIG. 1 and with additional reference to FIG. 2 which shows an exploded isometric view of two adjacent heat exchanger plate pairs 12 separated by one array of fins 14 which is in thermal contact with heat exchanger plate pairs 12, FIG. 3 which shows a cross-sectional view of heat exchanger 10 perpendicular to each heat exchanger plate pair 12, and FIG. 4 which shows a cross-sectional view of heat exchanger 10 parallel to heat exchange plate pairs 12. Each heat exchanger plate pair 12 includes two heat exchanger plates 16 which each may have a mating edge 18 and a concave region 20 delimited by mating edge 18. In this way, when two heat exchanger plates 16 are mated together along their respective mating edges 18, heat exchanger plate pair 12 defines an internal volume or fluid passage via concave regions 20.

Heat exchanger plates 16 include plate inlets 22 and plate outlets 24 which project outward from heat exchanger plate pairs 12. In this way, when heat exchanger plate pairs 12 are stacked together, plate inlets 22 of adjacent heat exchanger plate pairs 12 sealingly mate, thereby forming an inlet header 26 through the stack of heat exchanger plate pairs 12. Similarly, when heat exchanger plate pairs 12 are stacked together, plate outlets 24 of adjacent heat exchanger plate pairs 12 sealingly mate, thereby forming an outlet header 28 through the stack of heat exchanger plate pairs 12. Interfaces of heat exchanger plates 16, plate inlets 22 and plate outlets 24 may be joined and sealed, for example, by brazing. One end of inlet header 26 may be connected to a first medium supply conduit 30 while the other end of inlet header 26 may have no ports. Similarly, one end of outlet header 28 may be connected to a first medium return conduit 32 while the other end of outlet header 28 may have no ports. In this way, the first medium supplied through first medium supply conduit 30 is passed to each heat exchanger plate pair 12 via inlet header 26. The first medium then passes through each heat exchanger plate pair 12 along a flow axis 34 to outlet header 28 where it passes to first medium return conduit 32. While first medium supply conduit 30 and first medium return conduit 32 have been illustrated as being located on the same side of heat exchanger 10, it should be understood that first medium supply conduit 30 and first medium return conduit 32 may be located on opposite sides of heat exchanger 10. For clarity, the flow path of the first medium has been illustrated by first medium flow arrows 36 in FIG. 3 (for clarity, only select flow medium flow arrows have been identified by reference number).

As best shown in FIG. 4, inlet header 26 may be elliptical in cross-sectional shape. Consequently, inlet header 26 includes an inlet header major axis 38 which may be substantially parallel to flow axis 34. Inlet header 26 has a dimension or width $W_1$ along inlet header major axis 38 as well as along flow axis 34. Inlet header 26 also includes an inlet header minor axis 40 which may be substantially perpendicular to inlet header major axis 38. Inlet header 26 has a dimension or length $L_1$ along inlet header minor axis 40, consequently, length $L_1$ is in a direction perpendicular to inlet header major axis 38 and flow axis 34. An inlet header quadrant point 42 is defined at the intersection of inlet header major axis 38 and the outer perimeter of inlet header 26 which faces axially toward array of fins 14. Similarly, also as best shown in FIG. 4, outlet header 28 may be elliptical in cross-sectional shape. Consequently, outlet header 28 includes an outlet header major axis 44 which may be substantially parallel to flow axis 34. Outlet header 28 has dimension or width $W_2$ along outlet header major axis 44 as well as along flow axis 34. Outlet header 28 also includes an outlet header minor axis 46 which may be substantially perpendicular to outlet header major axis 44. Outlet header 28 has a dimension or length $L_2$ along outlet header minor axis 46, consequently, length $L_2$ is in a direction perpendicular to outlet header major axis 44 and flow axis 34. An outlet header quadrant point 48 is defined at the intersection of outlet header major axis 44 and the outer perimeter of outlet header 28 which faces axially toward array of fins 14.

Arrays of fins 14 will now be described with continued reference to FIGS. 1-4. Arrays of fins 14 include a plurality of fins 50 (for clarity, only select fins 14 have been identified by reference number) that extend from a fin array inlet end 52 to a fin array outlet end 54 in the same general direction as flow axis 34. Fins 50 also extend between adjacent heat exchanger plate pairs 12 such that fins 50 are in thermal contact with adjacent heat exchanger plate pairs 12, consequently, fins 50 define flow channels 56 (for clarity, only select flow channels 56 have been identified by reference number) between adjacent heat exchanger plate pairs 12. Fin array inlet end 52 defines flow channel inlets 58 (for clarity, only select flow channel inlets 58 have been identified by reference number) of each flow channel 56 for introducing the second medium into flow channels 56 while fin array outlet end 54 defines flow channel outlets 60 (for clarity, only select flow channel outlets 60 have been identified by reference number) of each flow channel 56 for expelling the second medium from flow channels 56. As illustrated, fins 50 are imperforate, thereby preventing the second medium from flowing from one flow channel 56 to any other flow channel 56; however, fins 50 may alternatively have features, for example only, louvers or apertures which allow the second medium to flow from one flow channel 56 to another flow channel 56. Also as illustrated, fins 50 are formed in a wave pattern in the direction of flow axis 34, however, fins 50 may alternatively be straight or formed as another shape. Also as illustrated, fin array inlet end 52 is proximal to outlet header 28 and fin array outlet end 54 is proximal to inlet header 26; however, this relationship may alternatively be reversed.

Fin array inlet end 52 includes an inlet cut-out area 62, thereby shortening the length of fins 50 that are centrally located while allowing a portion of fins 50 that are located closer to the sides of array of fins 14 to be positioned laterally of outlet header 28 such that a portion of fins 50 are positioned laterally from two opposing sides of outlet header 28. In this way, inlet cut-out area 62 partially surrounds outlet header 28. Inlet cut-out area 62 is spaced apart from outlet header 28 in the direction of flow axis 34 in order to allow flow of the second medium into flow channels 56. In order to maximize flow of the second medium into each flow channel 56 that is axially aligned with outlet header 28 while maximizing the length of each fin 50, a relationship between the width $W_2$, the length $L_2$, and an axial distance between outlet header quadrant point 48 and inlet cut-out area 62 has been discovered. This relationship is represented by the equation:

$$S_2 = A_2 \times \frac{L_2}{W_2} + B_2$$

where $S_2$ is the axial distance from outlet header quadrant point 48 and inlet cut-out area 62, $A_2$ is a coefficient in the range of 4.6 to 10.7 and $B_2$ is a coefficient in the range of 2 to 6. $A_2$ may preferably be 7.7 and $B_2$ may preferably be 4.7. In this way, inlet cut-out area 62 allows for maximum heat exchange from the second medium to the first medium by maximizing the length of fins 50 and by allowing maximum flow of the second medium into flow channels 56 that are axially aligned with outlet header 28. Inlet cut-out area 62 also allows fins 50 that are not axially aligned with outlet header 28 to be positioned laterally to outlet header 28, thereby providing support between adjacent heat exchanger plate pairs 12 and consequently not requiring other features to provide support between adjacent heat exchanger plates 2.

Similarly, fin array outlet end 54 includes an outlet cut-out area 64, thereby shortening the length of fins 50 that are centrally located while allowing a portion of fins 50 that are located closer to the sides of array of fins 14 to be positioned laterally of inlet header 26 such that a portion of fins 50 are positioned laterally from two opposing sides of inlet header 26. In this way, outlet cut-out area 64 partially surrounds inlet header 26. Outlet cut-out area 64 is spaced apart from inlet header 26 in the direction of flow axis 34 in order to allow flow of the second medium out of flow channels 56. In order to maximize flow of the second medium out of each flow channel 56 that is axially aligned with inlet header 26 while maximizing the length of each fin 50, a relationship between the width $W_1$, the length $L_1$, and an axial distance between inlet header quadrant point 42 and outlet cut-out area 64 has been discovered. This relationship is represented by the equation:

$$S_1 = A_1 \times \frac{L_1}{W_1} + B_1$$

where $S_1$ is the axial distance from inlet header quadrant point 42 and outlet cut-out area 64, $A_1$ is a coefficient in the range of 4.6 to 10.7 and $B_1$ is a coefficient in the range of 2 to 6. $A_1$ may preferably be 7.7 and $B_1$ may preferably be 4.7. In this way, outlet cut-out area 64 allows for maximum heat exchange from the second medium to the first medium by maximizing the length of fins 50 and by allowing maximum flow of the second medium out of flow channels 56 that are axially aligned with inlet header 26. Outlet cut-out area 64 also allows fins 50 that are not axially aligned with inlet header 26 to be positioned laterally to inlet header 26, thereby providing support between adjacent heat exchanger plate pairs 12 and consequently not requiring other features to provide support between adjacent heat exchanger plate pairs 12.

Figure 5:
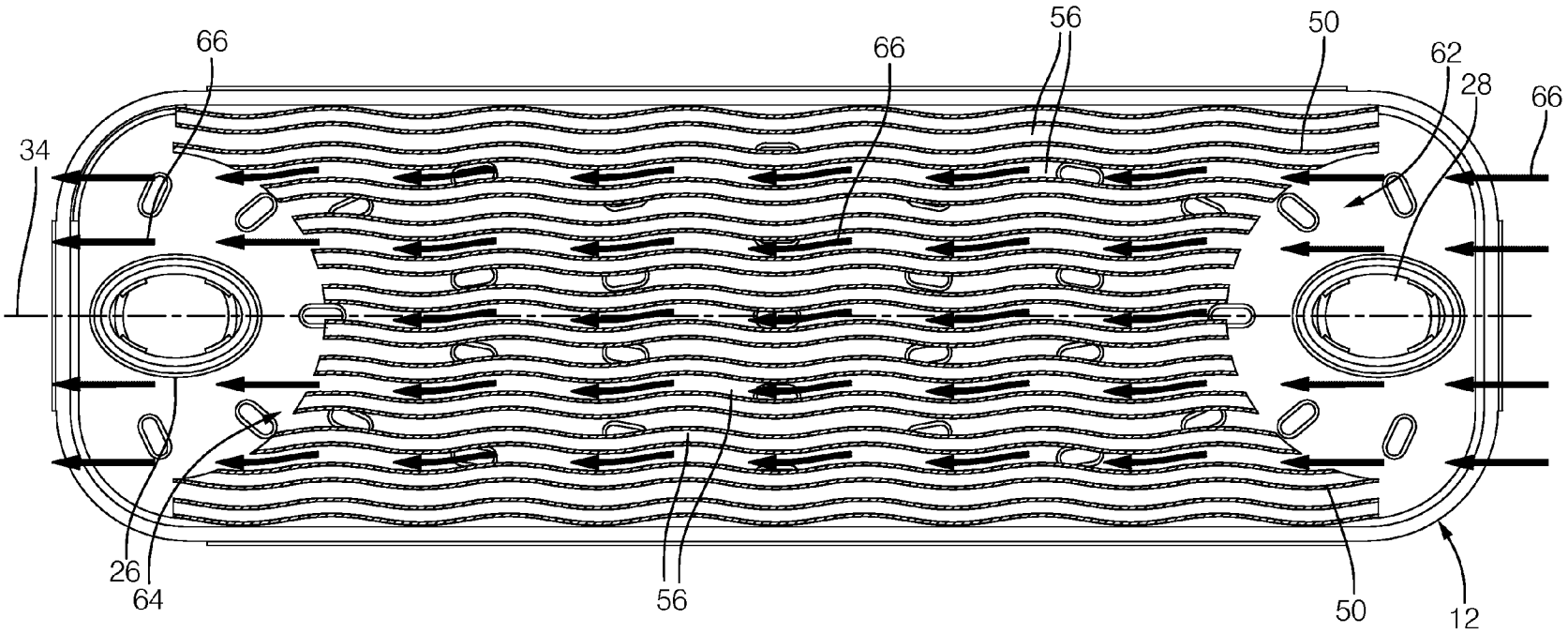
FIG. 5 is the cross-sectional view of FIG. 4 with arrows representing flow of a medium.

Reference will now be made to FIG. 5 which is the same cross-sectional view as FIG. 4. FIG. 5 includes second medium flow arrows 66 (for clarity, only select second medium flow arrows 66 have been identified by reference number) to illustrate the flow of the second medium through flow channels 56 along flow axis 34. As can be seen, inlet cut-out area 62 allows the second medium to enter even the flow channels 56 that are axially aligned with outlet header 28 while allowing some fins 50 to be positioned laterally from outlet header 28 in order to support adjacent heat exchanger plate pairs 12. Also as can be seen, outlet cut-out area 64 allows the second medium to exit even the flow channels 56 that are axially aligned with inlet header 26 while allowing some fins 50 to be positioned laterally from inlet header 26 in order to support adjacent heat exchanger plate pairs 12. As will now be evident, the flow of the first medium along flow axis 34 is parallel to, but in opposite direction as the flow of the second medium along flow axis 34. However; it should be understood that the flow of the first medium along flow axis 34 may be in the same direction as the flow of the second medium along flow axis 34.

While inlet cut-out area 62 and outlet cut-out area 64 have been illustrated as being substantially semi-circular in shape having a radius R centered at the center of outlet header 28 and inlet header 26 respectively, it should be understood that inlet cut-out area 62 and outlet cut-out area 64 may be made in other shapes, for example only, semi-elliptical or V-shaped.

While this invention has been described in terms of preferred embodiments thereof, it is not intended to be so limited, but rather only to the extent set forth in the claims that follow.

We claim:

1. A heat exchanger for transferring heat between a first medium and a second medium, the heat exchanger comprising:

a stack of heat exchanger plate pairs, each the heat exchanger plate pair consisting of a first heat exchanger plate and a second heat exchanger plate defining an internal volume between the first and second heat exchanger plates, and each the heat exchanger plate pair including an inlet for introducing the first medium into the internal volume and an outlet for discharging the first medium from the internal volume, wherein the first medium flows from the inlet to the outlet along a flow axis extending from the inlet to the outlet, wherein the inlets together form an inlet header through the heat exchanger plate pairs, and wherein the outlets together form an outlet header through the heat exchanger plate pairs, each of the first and second heat exchanger plates having a concave region between the inlet and the outlet with convex protrusions, each of the protrusions of each of the first and second heat exchanger plates contacting one of the protrusions of the other one of the first and second heat exchanger plates so that the concave regions of the first and second heat exchanger plates define the internal volume, the concave area bilaterally partially surrounding the inlet header and the outlet header with a portion of the protrusions arranged bilaterally from the inlet header and the outlet header;

an array of fins disposed between and in thermal contact with adjacent ones of the heat exchanger plate pairs, the array of fins defining parallel flow channels along the flow axis between adjacent the heat exchanger plate pairs, wherein the second medium flows through the flow channels along the flow axis, wherein one end of the array of fins includes a first cut-out area with a centrally located portion of the array of fins being shortened relative to two outer portions of the array of fins, which causes the two outer portions of the array of fins to be positioned laterally from two opposing sides of the one of the inlet header and the outlet header such that the first cut-out area bilaterally partially surrounds the one of the inlet header and the outlet header with the two outer portions, and wherein the other end of the array of fins includes a second cut-out area with the centrally located portion of the array of fins being shortened relative to the two outer portions of the array of fins which causes the two outer portions of the array of fins to be positioned laterally from two opposing sides of the other of the inlet header and the outlet header such that the second cut-out area bilaterally partially surrounds the other of the inlet header and the outlet header with the two outer portions, wherein one end of the flow channels defines flow channel inlets for introducing the second medium into the flow channels and the other end of the flow channels defines flow channel outlets for expelling the second medium from the flow channels and wherein the flow channel inlets and outlets that are axially aligned with one of the inlet header and the outlet header are spaced axially away from the one of the inlet header and the outlet header, wherein the two outer portions of the array of fins provide support to maintain separation of adjacent heat exchanger plate pairs and wherein the fins, the inlet header, and the outlet header provide the only support between adjacently stacked heat exchanger plate pairs.

2. The heat exchanger as claimed in claim 1, wherein the one of the inlet header and the outlet header includes a first quadrant point facing axially toward the first cut-out area and wherein the quadrant point is spaced axially away from an edge of the first cut-out area.

3. The heat exchanger as claimed in claim 2, wherein the first cut-out area is spaced axially away from the first quadrant point according to the equation:

$$S = A \times \frac{W}{L} + B$$

where S is the axial distance from the first quadrant point to the first cut-out area, A is a coefficient in the range of 4.6 to 10.7, W is the dimension of the one of the inlet header and the outlet header along the flow axis, L the dimension of the one of the inlet header and the outlet header perpendicular to the flow axis, and B is a coefficient in the range of 2 to 6.

4. The heat exchanger as claimed in claim 3, wherein A is 7.6 and B is 4.7.

5. The heat exchanger as claimed in claim 1, wherein:

the one of the inlet header and the outlet header includes a first quadrant point facing axially toward the first cut-out area and the first quadrant point is spaced axially from an edge of the first cut-out area; and the other of the inlet header and the outlet header includes a second quadrant point facing axially toward the second cut-out area and the second quadrant point is spaced axially from an edge of the second cut-out area.

6. The heat exchanger as claimed in claim 5 wherein the edge of the first cut-out area is spaced axially away from the first quadrant point according to the equation:

$$S_1 = A_1 \times L_1 W_1 + B_1$$

where $S_1$ is the axial distance from the first quadrant point to the edge of the first cut-out area, $A_1$ is a coefficient in the range of 4.6 to 10.7, $W_1$ is the dimension of the one of the inlet header and the outlet header along the flow axis, $L_1$ the dimension of the one of the inlet header and the outlet header perpendicular to the flow axis, and $B_1$ is a coefficient in the range of 2 to 6.

7. The heat exchanger as claimed in claim 6 wherein $A_1$ is 7.7 and $B_1$ is 4.7.

8. The heat exchanger as claimed in claim 6 wherein the second cut-out area is spaced axially away from the second quadrant point the axial distance $S_1$.

9. The heat exchanger as claimed in claim 6 wherein the second cut-out area is spaced axially away from the second quadrant point according to the equation:

$$S_2 = A_2 \times \frac{L_2}{W_2} + B_2$$

where $S_2$ is the axial distance from the second quadrant point to the second cut-out area, $A_2$ is a coefficient in the range of 4.6 to 10.7, $W_2$ is the dimension of the other of the inlet header and the outlet header along the flow axis, $L_2$ the dimension of the other of the inlet header and the outlet header perpendicular to the flow axis, and $B_2$ is a coefficient in the range of 2 to 6.

10. The heat exchanger as claimed in claim 9 wherein $A_2$ is 7.7 and $B_2$ is 4.7.

11. The heat exchanger as claimed in claim 8 wherein the first cut-out area is semi-circular and centered about the center of the one of the inlet header and the outlet header.

12. The heat exchanger as claimed in claim 1 wherein:

the first cut-out area is semi-circular and centered about the one of the inlet header and the outlet header; and the second cut-out area is semi-circular and centered about the other of the inlet header and the outlet header.

* * * * *